US008133018B2

(12) United States Patent
Dakowski et al.

(10) Patent No.: US 8,133,018 B2
(45) Date of Patent: Mar. 13, 2012

(54) HIGH-PRESSURE TURBINE OF A TURBOMACHINE

(75) Inventors: Mathieu Dakowski, Sucy en Brie (FR); Claire Dorin, Maisons-Alfort (FR); Alain Dominique Gendraud, Vernou Lacelle sur Seine (FR); Vincent Philippot, Savigny le Temple (FR)

(73) Assignee: SNECMA, Paris (FR)

( * ) Notice: Subject to any disclaimer, the term of this patent is extended or adjusted under 35 U.S.C. 154(b) by 1288 days.

(21) Appl. No.: 12/038,604

(22) Filed: Feb. 27, 2008

(65) Prior Publication Data

US 2008/0267768 A1 Oct. 30, 2008

(30) Foreign Application Priority Data

Feb. 28, 2007 (FR) ..... 07 01427

(51) Int. Cl.
*F01D 9/00* (2006.01)

(52) U.S. Cl. ..... 415/209.2; 415/209.3

(58) Field of Classification Search ..... 415/173.3, 415/176, 199.5, 209.2, 209.3
See application file for complete search history.

(56) References Cited

U.S. PATENT DOCUMENTS 3,314,648 A 4/1967 Howald
3,367,628 A * 2/1968 Fitton ..... 415/110
3,372,542 A * 3/1968 Sevetz ..... 60/748
3,842,595 A * 10/1974 Smith et al. ..... 60/804
3,966,352 A * 6/1976 White et al. ..... 415/115
3,975,901 A * 8/1976 Hallinger et al. ..... 60/786
4,023,919 A 5/1977 Patterson
4,214,851 A * 7/1980 Tuley et al. ..... 415/115
4,384,822 A * 5/1983 Schweikl et al. ..... 415/137
4,485,620 A 12/1984 Koenig et al.
4,552,509 A * 11/1985 Schweikl et al. ..... 415/135
4,798,514 A * 1/1989 Pask ..... 415/115
4,805,398 A * 2/1989 Jourdain et al. ..... 60/806
4,820,116 A * 4/1989 Hovan et al. ..... 415/115
4,863,345 A * 9/1989 Thompson et al. ..... 415/174.1
5,118,120 A * 6/1992 Drerup et al. ..... 277/628
5,332,358 A * 7/1994 Hemmelgarn et al. .... 415/174.5
6,196,794 B1 * 3/2001 Matsumoto ..... 415/191
6,305,899 B1 * 10/2001 Saunders ..... 415/9

* cited by examiner

*Primary Examiner* — Edward Look
*Assistant Examiner* — Adam Benson
(74) *Attorney, Agent, or Firm* — Oblon, Spivak, McClelland, Maier & Neustadt, L.L.P.

(57) ABSTRACT

A high-pressure turbine of a turbomachine, including at least one upstream guide vane element and an impeller mounted so as to rotate inside ring sectors attached to an annular support which is suspended from an outer casing, the upstream guide vane element including, at its radially inner end, a mechanism for attachment to an inner casing and, at its radially outer end, a mechanism for pressing axially on a fixed element of the turbine that is suspended from the outer casing independently of the annular support for attachment of the ring sectors.

8 Claims, 2 Drawing Sheets

HIGH-PRESSURE TURBINE OF A TURBOMACHINE

The present invention relates to a high-pressure turbine in a turbomachine such as in particular an aircraft turbojet or turbofan.

BACKGROUND OF THE INVENTION

A high-pressure turbine of a turbomachine comprises at least one stage comprising an upstream guide vane element formed of an annular array of fixed stator blades and an impeller mounted so as to rotate downstream of the upstream guide vane element in a cylindrical or frustoconical assembly of ring sectors placed circumferentially end-to-end. These ring sectors comprise, at their upstream and downstream ends, means for coupling to an annular support that is attached to an outer casing of the turbine by suspension means.

The radial clearances between the movable blades of the impeller and the ring sectors must be minimized to improve the performance of the turbomachine while preventing friction of the ends of the blades on the ring sectors, which would cause these ends to wear and the performance of the turbomachine to deteriorate at all operating speeds.

The upstream guide vane element of the high-pressure turbine comprises two coaxial walls of revolution which extend one inside the other and which are connected together by the fixed stator blades. It is fitted into the turbomachine by its inner wall of revolution which comprises an annular flange for attachment to an inner casing of the turbine. Sealing means are also provided at the upstream and downstream ends of the walls of revolution of the upstream guide vane element to limit leaks of gas flowing in the turbine.

In operation, the hot gases leaving the combustion chamber of the turbomachine flow over the blades of the upstream guide vane element and apply axial pressure to the latter which pushes the upstream guide vane element in the downstream direction. The outer periphery of the upstream guide vane element then tends to press axially on the annular support for coupling the ring sectors and to push it in the downstream direction, which causes random and uncontrolled variations in the radial clearances between the movable blades of the impeller and the ring sectors and therefore reduces the performance of the turbomachine.

SUMMARY OF THE INVENTION

The particular object of the invention is to provide a simple, effective and economical solution to this problem.

Accordingly it proposes a turbomachine comprising a high-pressure turbine comprising at least one upstream guide vane element formed of an annular array of fixed stator blades and an impeller mounted so as to rotate downstream of the upstream guide vane element and inside an assembly of ring sectors placed circumferentially end-to-end and supported by an annular support suspended from an outer casing, the upstream guide vane element comprising, at its radially inner end, means for attachment to an inner casing, and, at its radially outer end, means for pressing axially on a fixed element that is suspended from the outer casing independently of the annular support of the ring sectors, wherein the annular metal sheet comprises, on a radially inner portion, an annular groove oriented axially in the upstream direction and designed to receive a cylindrical rim of an outer wall of a combustion chamber arranged upstream of the upstream guide vane element.

In operation, the forces applied to the upstream guide vane element of the high-pressure turbine are sustained by the fixed element suspended from the outer casing independently of the support of the ring sectors, and are therefore no longer transmitted to the support of the ring sectors so that the forces sustained by this upstream guide vane element no longer have an influence on the radial clearances between the movable blades of the impeller and the ring sectors. These radial clearances may therefore be optimized in a more effective manner to improve the performance of the turbine.

According to another feature of the invention, this fixed element comprises an annular metal sheet which extends radially between the upstream guide vane element and the outer casing and which comprises, at its radially outer end, an annular flange for attachment to the outer casing. This annular metal sheet may also comprise, at its radially inner end, a radial annular endpiece for pressing on the upstream guide vane element.

The metal sheet comprises, over a radially inner portion, an annular groove oriented axially in the upstream direction and designed to receive a cylindrical rim of an outer wall of the combustion chamber situated upstream. The radially outer portion of this metal sheet may also comprise orifices evenly distributed about its axis of revolution for the passage of ventilation air.

The upstream guide vane element comprises a radial annular rim extending outward and forming means for pressing axially on the fixed element of the turbine. This radial rim may comprise a cylindrical rib for pressing axially on the fixed element of the turbine. Preferably, this radial rim is situated substantially level with the leading edges of the blades of the upstream guide vane element.

The invention also relates to an annular metal sheet for a turbomachine as described above, which comprises a frustoconical wall extending between an annular radially outer flange and an annular radial endpiece. The frustoconical wall comprises, over a radially outer portion, orifices evenly distributed about the axis of revolution of the wall for the passage of ventilation air, and over a radially inner portion, an annular groove.

BRIEF DESCRIPTION OF THE DRAWINGS

The invention will be better understood and other features, details and advantages of the latter will appear more clearly on reading the following description, made as a nonlimiting example and with reference to the appended drawings in which.

DESCRIPTION OF THE PRIOR ART

Figure 1:
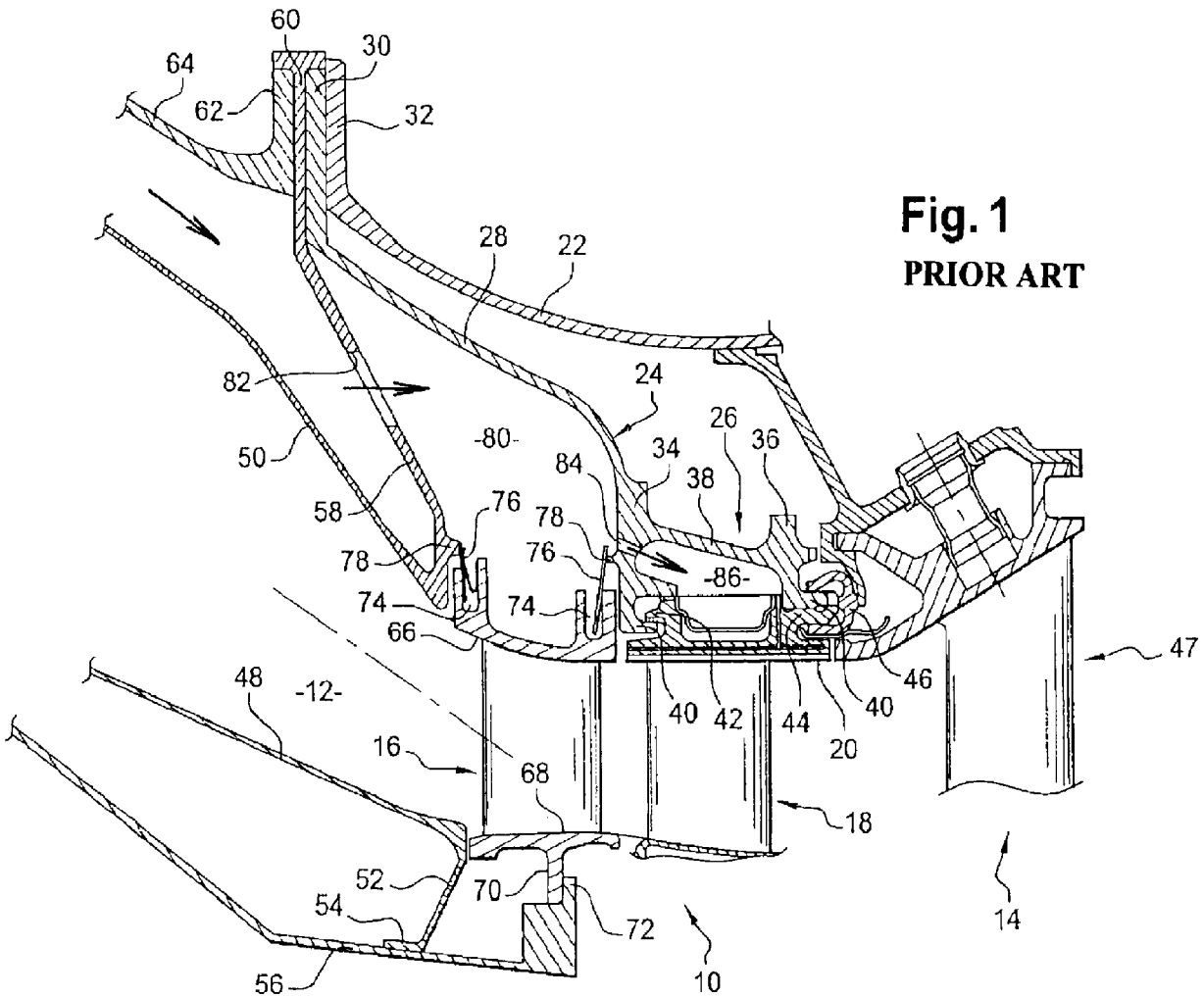
Fig. 1 PRIOR ART
FIG. 1 is a partial schematic half-view in axial section of a high-pressure turbine of a turbomachine according to the art prior to the invention.

FIG. 1 represents in a schematic manner a portion of a turbomachine such as an aircraft turbojet or turboprop comprising a high-pressure turbine 10 arranged downstream of a combustion chamber 12, and upstream of a low-pressure turbine 14 of the turbomachine.

The combustion chamber 12 comprises an inner wall of revolution 48 and an outer wall of revolution 50 extending one inside the other. The inner wall 48 is connected at its downstream end to a radially outer end of a frustoconical wall 52 whose radially inner end comprises an annular flange 54 attached to an inner casing 56 of the combustion chamber. The outer wall 50 of the chamber is connected at its downstream end to a radially inner end of a frustoconical wall 58 which comprises, at its radially outer end, a radially outer annular flange 60 for attachment to a corresponding annular flange 62 of an outer casing 64 of the chamber.

The high-pressure turbine 10 comprises a single turbine stage comprising an upstream guide vane element 16 formed of an annular array of fixed stator blades, and a impeller 18 mounted so as to rotate downstream of the upstream guide vane element 16.

The low-pressure turbine 14 comprises several turbine stages, each of these stages also comprising an upstream guide vane element and a impeller, only the upstream guide vane element 47 of the upstream low-pressure stage being visible in FIG. 1.

The impeller 18 of the high-pressure turbine 10 rotates inside a substantially cylindrical assembly of ring sectors 20 that are placed circumferentially end-to-end and suspended from a turbine casing 22 by means of an annular support 24. This annular support 24 comprises, on its inner periphery, means 26 for coupling the ring sectors 22 and comprises a frustoconical wall 28 which extends in the upstream direction and outward and which is connected at its radially outer end to a radially outer annular flange 30 for attachment to a corresponding annular flange 32 of the turbine casing 22. This flange 30 is inserted axially between the flange 60 of the frustoconical wall 58 and the flange 32 of the turbine casing 22 and is clamped axially between these flanges by appropriate means of the screw-nut type.

The annular support 24 comprises on its inner periphery two radial annular walls 34, 36, respectively upstream and downstream, that are connected to one another via a cylindrical wall 38. The radial walls 34, 36 comprise, at their radially inner ends, cylindrical rims 40 oriented in the downstream direction that interact with circumferential hooks 42, 44 provided at the upstream and downstream ends of the ring sectors 20. An annular, C-section locking member 46 is engaged axially from the downstream direction on the downstream cylindrical rim 40 of the support and on the downstream hooks 44 of the ring sectors to lock the assembly.

The frustoconical wall 28 of the annular support 24 defines, with the frustoconical wall 58 of the chamber, an annular enclosure 80 that is supplied with ventilation and cooling air through orifices 82 formed in the frustoconical wall 58. Orifices 84 are formed in the upstream radial wall 34 of the annular support 24 to establish a fluidic communication between the enclosure 80 and an annular cavity 86 for cooling the ring sectors 20 delimited externally by the cylindrical wall 38 of the annular support.

The upstream guide vane element 16 of the high-pressure turbine 10 is formed of two coaxial walls of revolution 66, 68 which extend one inside the other and which are connected together by the fixed stator blades.

The inner wall 68 of the upstream guide vane element comprises an annular flange 70 which extends radially inward from its inner surface and which is attached by appropriate means to a corresponding flange 72 provided at the downstream end of the inner casing 56 of the combustion chamber 12. The upstream and downstream ends of the inner wall 68 of the upstream guide vane element interact sealingly with the downstream end of the inner wall 48 of the combustion chamber and with the upstream end of the platforms of the movable blades of the impeller 18, respectively, to prevent the gases from the annular exhaust stream of the turbine from traveling radially toward the inside of the inner wall 68.

The outer wall 66 of the upstream guide vane element comprises, at each of its upstream and downstream ends, an annular groove 74 opening radially outward. Annular seals 76 are housed in these grooves 74 and interact with the cylindrical ribs 78 formed on the frustoconical wall 58 and on the upstream radial wall 34 of the annular support 24, respectively, to prevent the gases traveling from the turbine stream radially toward the outside of the outer wall 66, and conversely, to prevent air traveling from the enclosure 80 radially inward into the stream of the turbine.

In operation of the turbomachine, the upstream guide vane element 16 is pushed in the downstream direction by the flow of the gases in the turbine and its outer periphery that is not rigidly connected to a fixed element of the turbine moves slightly in the downstream direction until the radially outer end of the outer wall 66 of the upstream guide vane element presses axially on an upstream face of the upstream radial wall 34 of the annular support 24. The upstream guide vane element 16 then exerts an axial force directed in the downstream direction onto the support which deforms and causes a movement of the ring sectors 20 and a change in the radial clearances between the movable blades of the impeller 18 and the ring sectors.

DESCRIPTION OF THE PREFERRED EMBODIMENT

The invention makes it possible to provide a simple solution to this problem thanks to the outer periphery of the upstream guide vane element 16 pressing axially on another fixed element of the turbine that is suspended from the outer casing 22 independently of the support 24 for attachment of the ring sectors. The forces applied to the upstream guide vane element are therefore sustained by the fixed element and are therefore not transmitted to the support 24.

Figure 2:
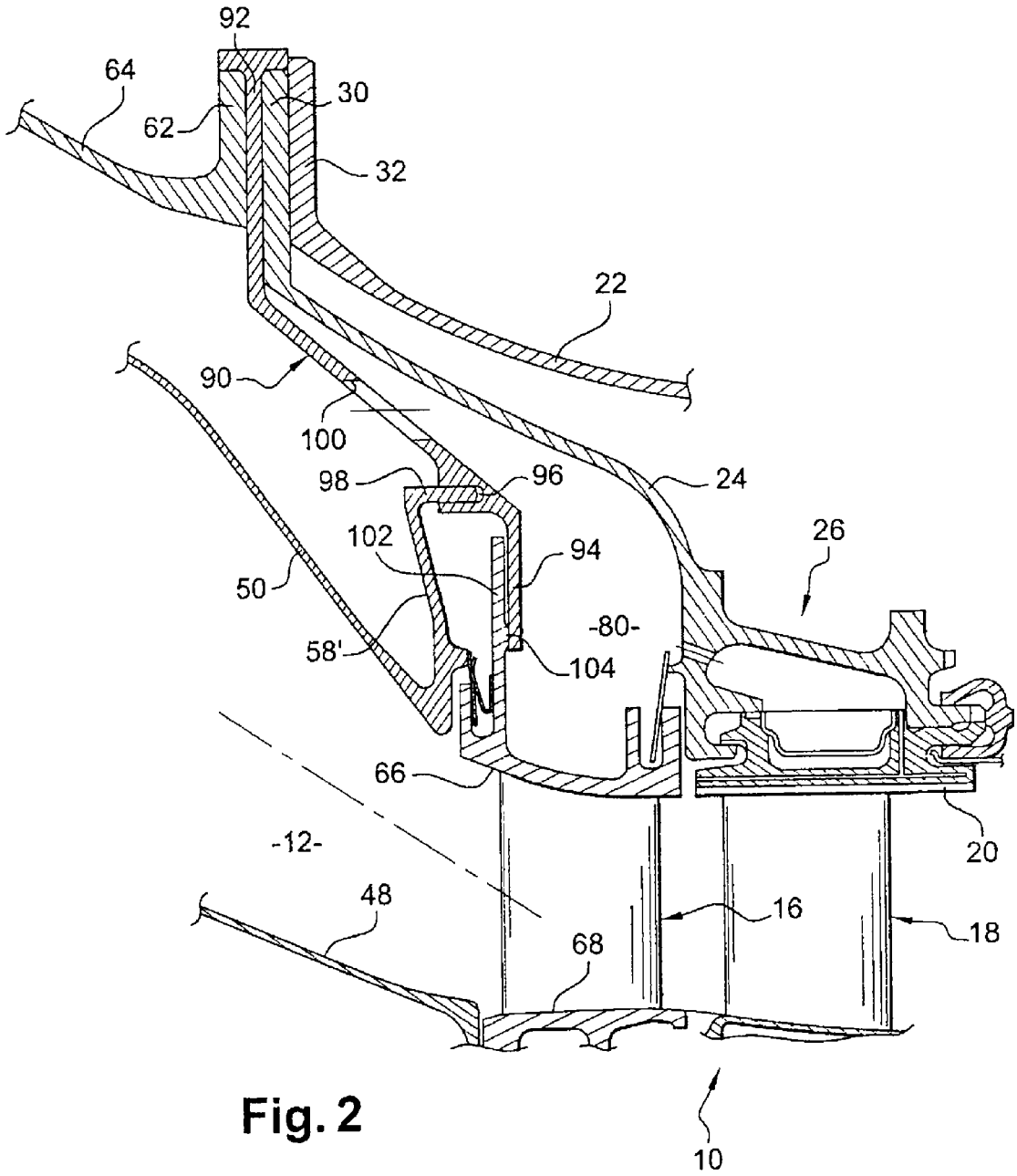
FIG. 2 is a partial schematic half-view in axial section of a high-pressure turbine of a turbomachine according to the invention.

In one embodiment of the invention shown in FIG. 2, this fixed element is formed by an annular metal sheet 90 which extends radially about the axis of the turbine and about the upstream guide vane element 16. This metal sheet 90 has a substantially frustoconical shape and comprises, at its radially outer end, a radially outer annular flange 92 which is clamped axially between the flange 62 of the outer casing 64 and the flange 30 of the annular support 24.

The radially inner end of the metal sheet comprises a radial annular endpiece 94 which defines, on the upstream side, a bearing face of the upstream guide vane element 16. The radially inner end of the metal sheet also comprises an annular groove 96 opening axially upstream.

The outer wall 50 of the chamber is connected at its downstream end to a frustoconical wall 58' which has a radial dimension that is less than the wall 58 of FIG. 1 and that comprises, at its radially outer end, a cylindrical rim 98 oriented in the downstream direction and engaged in the groove 96 of the metal sheet 90. The reduction in the radial dimension of the frustoconical wall 58' makes it possible to reduce the temperature variances between the radially inner and outer ends of this wall and therefore to increase its service life.

The metal sheet 90 also comprises orifices 100 for ventilation air to travel through to supply the annular enclosure 80 with air, these orifices 100 being evenly distributed about the axis of the turbine.

The upstream guide vane element 16 of FIG. 2 comprises inner rings 68 and outer rings 66 similar to those of FIG. 1, the outer ring 66 of the upstream guide vane element also comprising, at its upstream end, a radial annular rim 102 extending outward from its outer surface. This radial rim 102 comprises, on the downstream side, a cylindrical rib 104 pressing axially on the radial endpiece 94 of the metal sheet 90. In the example shown, the rim 102 extends substantially level with the leading edges of the fixed blades of the upstream guide vane element.

In operation, the upstream guide vane element, that is pushed in the downstream direction by the hot gases leaving the combustion chamber, transmits a portion of the forces that it sustains to the annular metal sheet 90 via axial pressure of its radial rim 102 on the endpiece 94 of the metal sheet. The metal sheet may if necessary deform elastically to sustain the forces to which the upstream guide vane element is subjected. The endpiece 94 of the metal sheet is at a sufficient axial distance from the support 24 so as not to come into contact with the latter in operation. This support 24 is therefore no longer pushed in the downstream direction by the upstream guide vane element 16 which makes it possible to keep the radial clearances constant between the movable blades and the ring sectors 20.

The invention claimed is:

1. A turbomachine comprising a high-pressure turbine comprising at least one upstream guide vane element formed of an annular array of fixed stator blades and an impeller mounted so as to rotate downstream of the upstream guide vane element and inside an assembly of ring sectors placed circumferentially end-to-end and supported by an annular support suspended from an outer casing, the upstream guide vane element comprising, at a radially inner end, means for attachment to an inner casing, and, at a radially outer end means for pressing axially on a fixed element that is suspended from the outer casing independently of the annular support of the ring sectors, wherein said fixed element comprises, on a radially inner portion, an annular groove oriented axially in an upstream direction and designed to receive a cylindrical rim of an outer wall of a combustion chamber arranged upstream of the upstream guide vane element, and wherein said annular groove comprises at least one lateral cylindrical surface in abutment against a cylindrical surface of said cylindrical rim for centering the outer wall of the combustion chamber relative to a longitudinal axis of the turbomachine.

2. The turbomachine as claimed in claim 1, wherein the fixed element is an annular metal sheet which extends radially between the upstream guide vane element and the outer casing.

3. The turbomachine as claimed in claim 2, wherein the annular metal sheet comprises, at its radially outer end, an annular flange for attachment to the outer casing.

4. The turbomachine as claimed in claim 2, wherein the annular metal sheet comprises, at its radially inner end, a radial annular endpiece for pressing on the upstream guide vane element.

5. The turbomachine as claimed in claim 2, wherein a radially outer portion of the annular metal sheet comprises orifices evenly distributed about its axis of revolution for the passage of ventilation air.

6. The turbomachine as claimed in claim 1, wherein the upstream guide vane element comprises a radial annular rim extending outward and forming means for pressing axially on the fixed element of the turbine.

7. The turbomachine as claimed in claim 6, wherein the radial rim comprises a cylindrical rib for pressing axially on the fixed element of the turbine.

8. The turbomachine as claimed in claim 6, wherein the radial rim is situated substantially level with leading edges of the blades of the upstream guide vane element.

* * * * *